US005658397A

United States Patent [19]

Kogiku et al.

[11] Patent Number: 5,658,397

[45] Date of Patent: *Aug. 19, 1997

[54] IRON-BASED AMORPHOUS ALLOY THIN STRIP AND TRANSFORMERS MADE THEREFROM

[75] Inventors: Fumio Kogiku; Masao Yukumoto; Kensuke Matsuki, all of Chiba, Japan

[73] Assignee: Kawasaki Steel Corporation, Japan

[ * ] Notice: The term of this patent shall not extend beyond the expiration date of Pat. No. 5,522,947.

[21] Appl. No.: 507,590

[22] Filed: Jul. 26, 1995

[30] Foreign Application Priority Data

May 18, 1995 [JP] Japan ..... 7-119786

[51] Int. Cl.[6] ..... H01F 1/153

[52] U.S. Cl. ..... 148/304; 148/307; 420/117; 420/121

[58] Field of Search ..... 148/304, 403, 148/307; 420/117, 121

[56] References Cited

U.S. PATENT DOCUMENTS

| | | | |
|---|---|---|---|
| 4,587,507 | 5/1986 | Takayama et al. | 148/304 |
| 4,637,843 | 1/1987 | Takayama et al. | 148/403 |
| 5,522,947 | 6/1996 | Kogiku et al. | 148/304 |

FOREIGN PATENT DOCUMENTS

| | | | |
|---|---|---|---|
| 57-193006 | 11/1982 | Japan | 148/304 |
| 57-193005 | 11/1982 | Japan | 148/304 |

*Primary Examiner*—John Sheehan

*Attorney, Agent, or Firm*—Austin R. Miller

[57] ABSTRACT

An iron-based amorphous alloy thin strip for wound transformers has a composition expressed by a chemical formula:

$Fe_aB_bSi_cMn_d$ where about 78≦a≦ about 82 at %, about 8≦b≦ about 15 at %, 4≦c≦ about 14 at %, and about 0.2≦d≦ about 1.0 at %. The ratio (building factor) of the iron loss of a wound core obtained from the above-described alloy thin strip to the iron loss of a single strip is about 1.5 or below.

5 Claims, 5 Drawing Sheets

IRON-BASED AMORPHOUS ALLOY THIN STRIP AND TRANSFORMERS MADE THEREFROM

BACKGROUND OF THE INVENTION

1. Field of the Invention

The present invention relates to an iron-based amorphous alloy thin strip suitable for use as a wound transformer material, and more particularly, to an iron-based amorphous alloy thin strip which assures an improved ratio (building factor) of the iron loss of a wound core obtained by using the iron-based amorphous alloy thin strip to the iron loss of a single unwound strip.

2. Description of the Related Art

A so-called amorphous alloy thin strip having a thickness of several tens of μm and a disordered atomic array is obtained by ejecting, for example, a Fe—B—Si type molten alloy onto the surface of a cooling roll rotating at high speed by the single roll process or the like and thereby rapidly solidifying the molten alloy at a cooling rate of $10^5$ to $10_6$° C./s. Such an amorphous alloy thin strip is disclosed in Japanese Patent Laid-Open Nos. Sho 54-148122, Sho 55-94460 and Sho 57-137451.

Such an amorphous alloy thin strip is readily magnetized and exhibits magnetic characteristics including iron loss. Thus, it has been put to practical use as an iron core material for transformers.

However, although such a Fe—B—Si three-element type amorphous alloy thin strip assures a relatively low iron loss, improvement in the iron loss is quite limited. Hence, attempts have been made to add various elements to the above-described three-element type amorphous alloy as fourth components.

For example, Japanese Patent Publication No. Hei 1-54422 proposes a Fe—B—Si type amorphous alloy in which Mn and Ni are present in an amount of 0.5 to 3 at % as an iron-based amorphous alloy having a low iron loss and exhibiting excellent insulation coating properties.

Japanese Patent Laid-Open No. Sho 62-192560 proposes a Fe—B—Si type amorphous alloy in which at least one element selected from Cr, Mo, Ta, Mn, Ni, Co, V, Nb and W is present in an amount of 0.05 to 5 at % and which has a surface roughness adjusted by, for example, rolling.

Neither Japanese Patent Publication No. Hei 1-54422 nor Japanese patent Laid-Open No. Sho 62-192560 gives consideration to the magnetic characteristics of a wound core obtained from the amorphous alloy, although Japanese Patent Publication No. Hei 1-54422 refers to an improvement in the interlayer insulation in a laminated structure and Japanese Patent Laid-Open No. Sho 62-192560 refers to an improvement in the space factor of a laminated structure.

Japanese Patent Laid-Open No. Hei 5-132744 discloses an alloy in which Sn is added to the Fe—B—Si type alloy to increase the saturation magnetic flux density without deteriorating iron loss and magnetic permeability, and a method of manufacturing an iron core using such an alloy.

The example of the iron loss ($W_{13/50}$) given in Japanese Patent Laid-Open No. Hei 5-132744 is 0.2 W/kg or above in a toroidal wound core. This value, however, is not low enough to meet the requirements made in recent years.

SUMMARY OF THE INVENTION

In view of the aforementioned problems of the prior art, an object of the present invention is to provide an iron-based amorphous alloy thin strip which exhibits excellent magnetic characteristics not only in a single strip but also in a wound core (including both a circular core and a non-circular core), i.e., which has a small building factor.

To achieve the above object, the present invention provides an iron-based amorphous alloy thin strip for wound transformers which has a composition expressed by the chemical formula:

$$Fe_aB_bSi_cMn_d$$

where about $78 \leqq a \leqq$ about 82 at %, about $8 \leqq b \leqq$ about 15 at %, about $4 \leqq c \leqq$ about 14 at %, and about $0.2 \leqq d \leqq$ about 1.0 at %, and in which the ratio (building factor) of the iron loss of a wound core obtained from the above-described alloy thin strip to the iron loss of a single unwound strip is about 1.5 or below.

In the present invention, excellent iron loss characteristics can be assured even in a wound core which is bent at a radius of about 50 mm or below.

To improve the iron loss of a wound core obtained from a Fe—B—Si type iron-based amorphous alloy thin strip, the present inventors paid careful attention to the strain applied to the material during manufacture, intensively studied strain dependency of iron loss when a fourth element is added to the alloy, and obtained the following findings.

(1) Application of a compression stress to the material generally deteriorates the magnetic characteristics thereof.

(2) Addition of Mn reduces deterioration in the magnetic characteristics which occurs under compression stress.

(3) If a material in which Mn is present is used to manufacture a wound core, deterioration in the iron loss which occurs in the wound core is improved.

(4) If a material in which Mn is present is used to manufacture a wound core, deterioration in the iron loss which occurs in the wound core is improved even if the manufacturing process includes bending of the core at a radius of about 50 mm or below.

The present invention is based on the above-described findings.

The results of the experiments with which the present invention originates will be described below.

DETAILED DESCRIPTION OF THE INVENTION

It will be appreciated that the following description is intended to refer to the specific embodiments of the invention described hereinbelow and as represented in the Figures and examples and is not intended to define or limit the invention other than in the appended claims.

Figure 1:
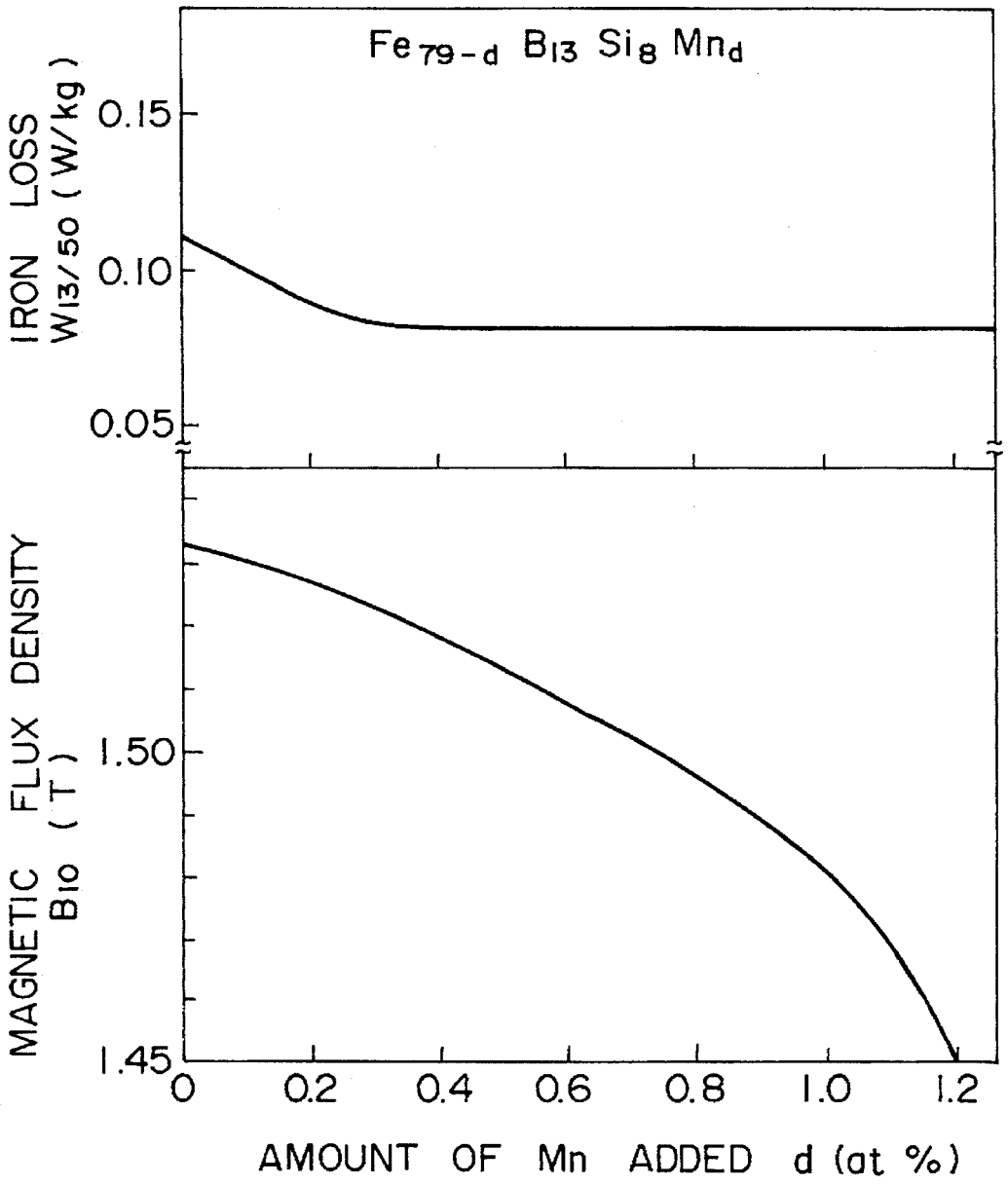
FIG. 1 is a graphic representation of the relationship between the magnetic characteristics in a single strip obtained from an iron-based amorphous alloy thin strip having a composition expressed by $Fe_{79-d}B_{13}Si_8Mn_d$ and the amount of Mn added thereto.

FIG. 1 illustrates the relationship between the amount of Mn present in an iron-based amorphous alloy thin strip having a composition expressed by $Fe_{79-d}B_{13}Si_8Mn_d$ and the magnetic characteristics of the thin strip.

Figure 2:
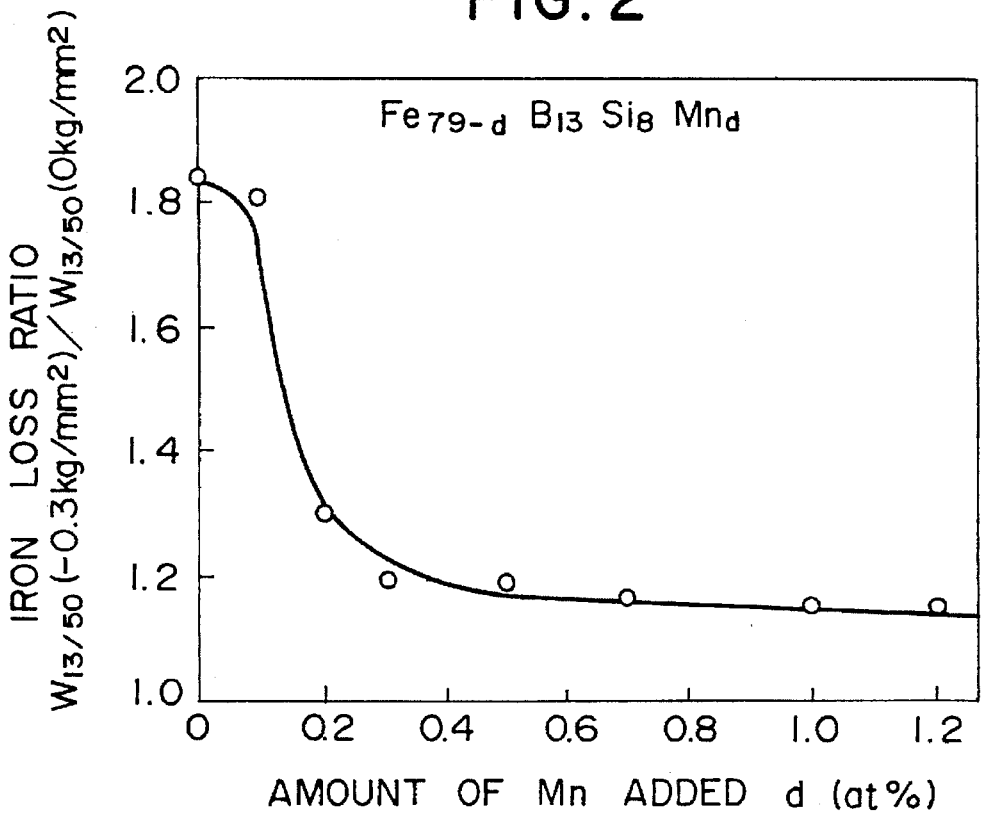
FIG. 2 is a graphic representation of the relationship between the ratio of the iron loss which occurs in the iron-based amorphous alloy thin strip having the composition described with respect to FIG. 1 under compression stress to the iron loss when no compression stress is applied to the strip and the amount of Mn added.

FIG. 2 illustrates the relationship between the amount of Mn which is present in the above-described thin strip and the value obtained by dividing the iron loss value when a compression stress of 0.3 kg/mm$^2$ is applied to the thin strip in a longitudinal direction thereof by the iron loss value when the applied compression stress is 0 kg/mm$^2$ (energized at 50 Hz, 1.3 T in both cases).

The amorphous alloy thin strip employed in the experiments conducted to obtain the results shown in FIGS. 1 and 2 had a thickness of 25 μm and a width of 20 mm. The measurements of iron loss values were performed on the thin strips which were subjected to annealing in a magnetic field at 390° C. for an hour.

As can be seen from FIGS. 1 and 2, when the amount of Mn is about 0.2 at % or above, excellent magnetic characteristics can be obtained in a single strip, and an increase in the iron loss value when compression stress is applied can be effectively prevented.

The above-mentioned effects are particularly remarkable when the amount of Mn is about 0.3 at % or above.

The reasons why the composition of the alloy thin strip is restricted to the above-described range will be explained below.

Fe: 78–82 at %

Fe constitutes the major structural component of the magnetic material. The preferred proportion thereof ranges between about 78 and about 82 at %, because at less than about 78 at %, the magnetic flux density cannot be increased to a practical level and because at more than about 82 at %, the iron loss increases and thermal stability deteriorates.

B: 8–15 at %

B is essential to provide an amorphous state. The preferred proportion thereof is between about 8 and about 15 at % because it is difficult to obtain an amorphous state, iron loss increases at less than about 8 at %, and the magnetic flux density is reduced and the Curie temperature decreases at more than about 15 at %.

Si: 4–14 at %

Addition of Si is essential to provide an amorphous material. It also maintains the Curie point at a high value. The preferred proportion thereof is between about 4 and about 14 at %. The Curie point decreases to an impractical value at less than about 4 at %. Iron loss increases at more than about 14%. A reduction in the amount of Si is effective to reduce iron loss particularly when the amount of Fe exceeds 80 at %.

Mn: 0.2–1.0 at %

Addition of Mn is mandatory in this invention. At less than about 0.2 at %, excellent magnetic characteristics cannot be obtained in a single unwound strip and an increase in the iron loss value when a compression stress is applied cannot be inhibited, as mentioned in connection with FIG. 2. Thus, the preferred proportion of Mn is about 0.2 at % or above.

The upper limit of the proportion of Mn is set to about 1.0 at % for the following reasons. Generally, an increase in the designed magnetic flux density of a transformer assures a reduction in the size of the transformer. Thus, the higher the designed magnetic flux density, the better.

The designed magnetic flux density of an operating wound transformer which employs an amorphous material is generally between about 1.3 and about 1.4 T at a temperature of 100° C. To achieve this, a magnetic flux density $B_{10}$ of about 1.48 T or above at room temperatures is necessary.

It is apparent from FIG. 1 that the amount of Mn which corresponds to a magnetic flux density $B_{10}$ of 1.48 T or above is about 1.0 at % or below.

This is how the upper limit of the proportion of Mn is determined.

The more preferred proportion of Mn assures a relatively high magnetic flux density between about 0.3 and about 0.5 at %.

EXAMPLES

Example 1

Amorphous alloy thin strips were manufactured by ejecting molten alloys having a composition expressed by $Fe_{79-d}B_{13}Si_8Mn_d$ where d was 0, 0.1, 0.2, 0.3, 0.5, 0.7, 1.0, 1.2 at %, respectively, on the surface of a Cu roll which was rotating at a high speed in a $CO_2$ atmosphere which included 4 vol % or less of $H_2$. Each of the amorphous alloy thin strips had a thickness of 25 μm, a width of 200 mm and a surface roughness of about 0.6 μm in terms of a mean roughness along the centerline Ra.

A circular wound core sample, having an inner diameter of 100 mm and an outer diameter of 110 mm, was manufactured from each of the thin strips. An iron loss $W_{13/50}$ of the wound core was measured after the wound core was annealed at 390° C. in an Ar atmosphere for 30 minutes to 2 hours while a magnetic field of 10 Oe was applied to the core in a circumferential direction. The results of the measurements are shown in FIG. 3.

In the core on which measurements of the iron loss were conducted, the number of turns of the primary coil was 200 and the number of turns of the secondary coil was 100. For iron loss measurements, the primary coil was energized and the power generated in the secondary coil was measured.

Figure 3:
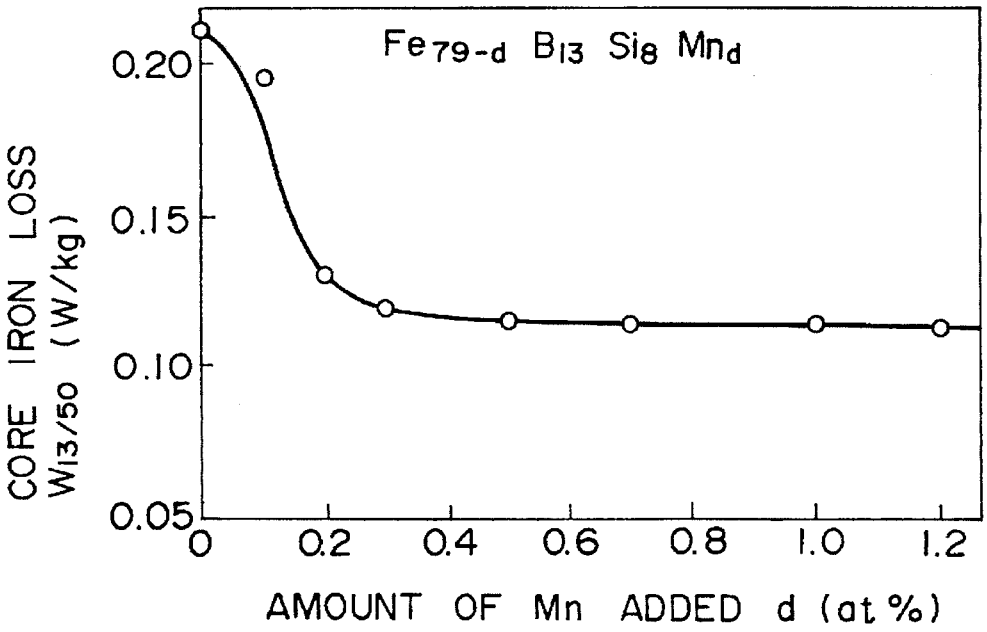
FIG. 3 is a graphic representation showing the relationship between the iron loss which occurs in a circular wound core obtained from the iron-based amorphous alloy thin strip having the above-described composition and the amount of Mn added.
Figure 4:
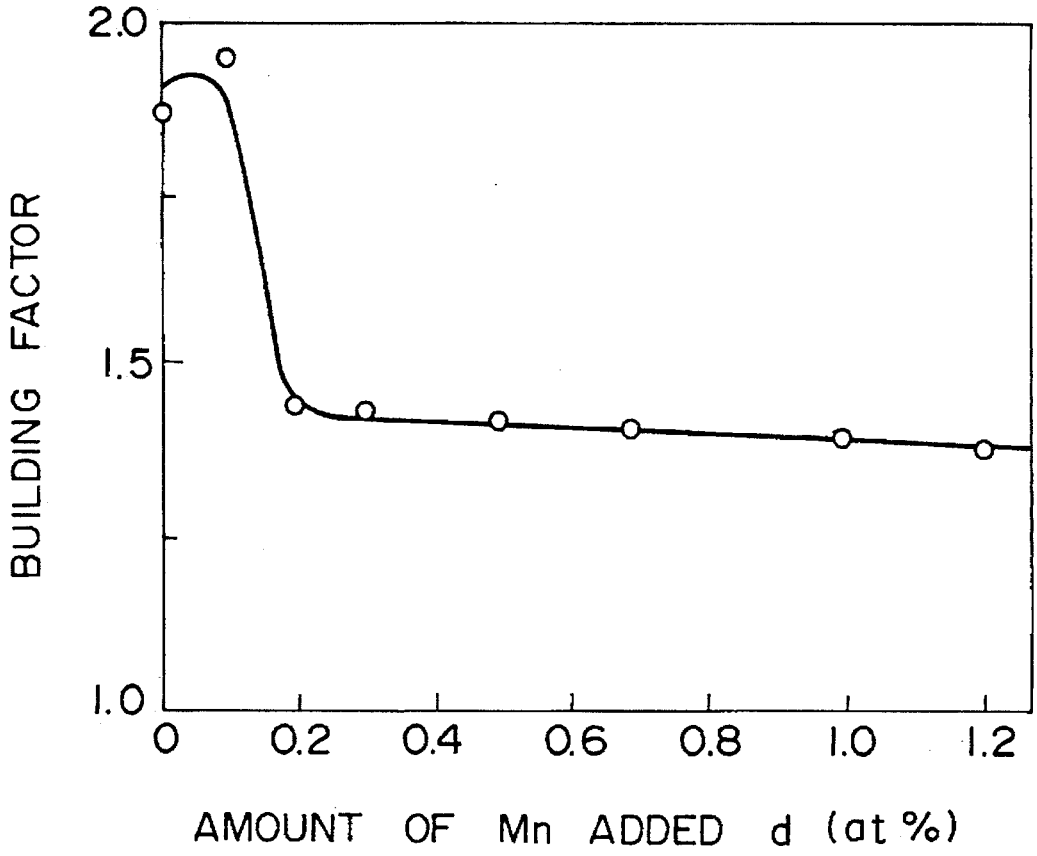
FIG. 4 is a graphic representation showing the relationship between the building factor of a circular wound core obtained from the iron-based amorphous alloy thin strip having the above-described composition and the amount of Mn added.

FIG. 4 shows the relationship between the amount of Mn added and the value, i.e., the building factor (BF), obtained by dividing the iron loss value of the wound core, shown in FIG. 3, by the iron loss value in a single unwound strip having the same composition as that of the material used to manufacture the core.

Measurements of the iron loss of a single strip were conducted, using a single strip magnetism measuring device, on a sample, having a width of 20 mm and a length of 150 mm and annealed in the same manner as that of the wound core while a magnetic field was applied to the sample in a longitudinal direction thereof.

As is clear from FIG. 3, when the proportion of Mn is about 0.2 at % or above, the iron loss $W_{13/50}$ of the circular wound core is as low as about 0.15 W/kg or below.

As is apparent from FIG. 4, when the proportion of Mn is about 0.2 at % or above, the BF value is about 1.5 or below. The BF value of a conventional amorphous alloy thin strip is about 2.0.

Example 2

Amorphous alloy thin strips, each having a thickness of 25 μm, a width of 200 mm and a surface roughness of about 0.6 μm in terms of a mean roughness along the centerline Ra, were manufactured from molten alloys having compositions of $Fe_{78.6}B_{13}Si_8Mn_{0.4}$ and $Fe_{79}B_{13}Si_8$ in the same manner as Example 1.

5 mm-thick circular wound core samples, respectively having inner diameters of 40 mm, 60 mm, 80 mm, 100 mm and 120 mm, were manufactured using the obtained thin strips. The iron loss $W_{13/50}$ and the building factor thereof were measured after each of the core samples was annealed in the same manner as Example 1.

Figure 5:
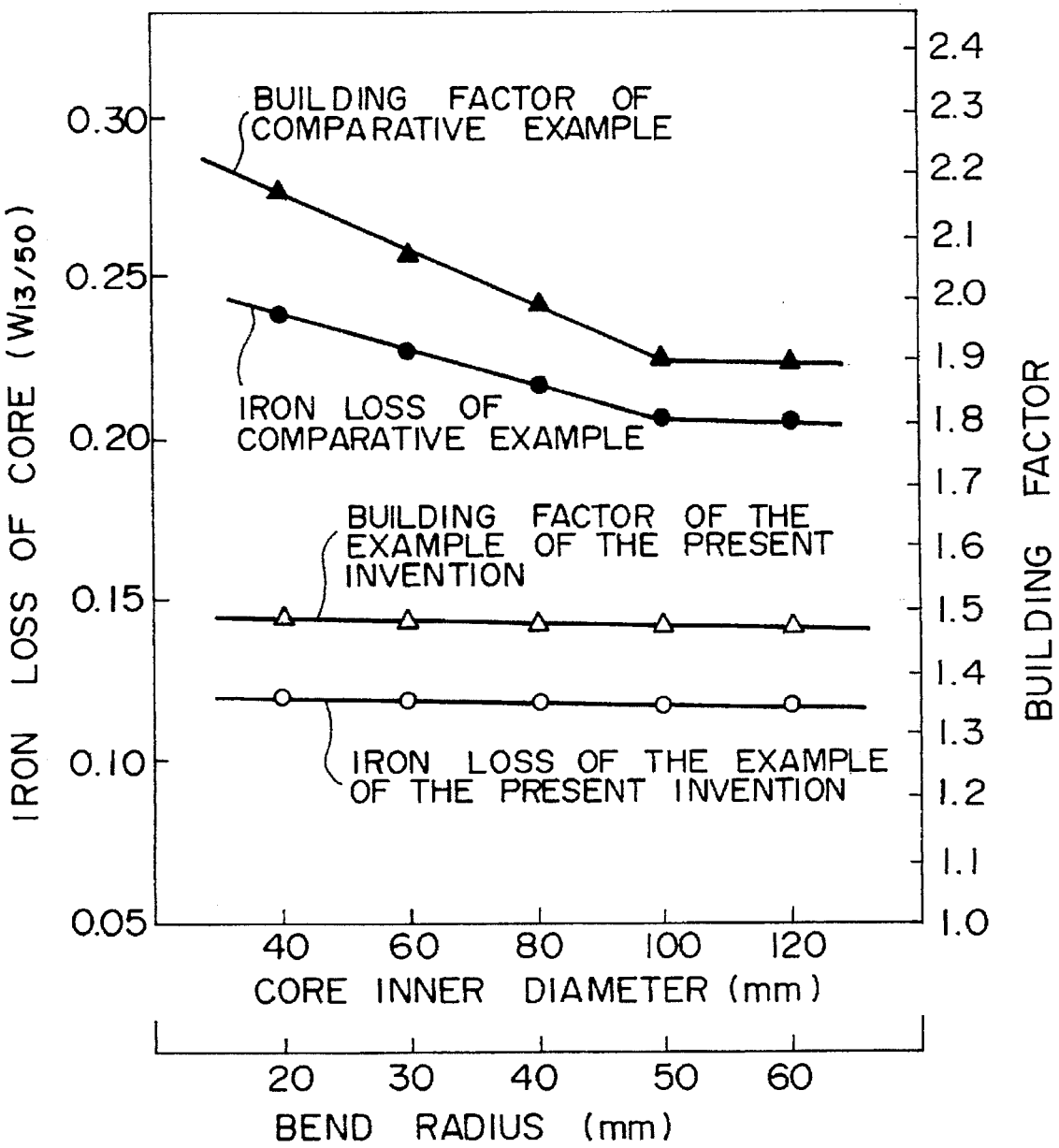
FIG. 5 is a graphic representation showing the relationships between the iron loss values and building factors of circular wound cores obtained from iron-based amorphous alloy thin strips having compositions expressed by $Fe_{78.6}B_{13}Si_8Mn_{0.4}$ and $Fe_{79}B_{13}Si_8$ and the bend radii.

The results of the measurements are shown in FIG. 5. As can be seen from FIG. 5, when an adequate amount of Mn was added, no deterioration in the iron loss $W_{13/50}$ of the circular wound core was seen even when the core manufacturing process included bending at a radius of about 50 mm or below, and an iron loss of about 0.15 W/kg or below could be obtained. The building factor was about 1.5 or below.

In conventional materials in which no Mn was present, the iron loss values were high as compared with the iron loss values in the wound cores according to the present invention. The iron loss rapidly increased particularly in circular wound cores in which the bending radius was about 50 mm or below. The building factor exceeded about 2.0.

Example 3

Amorphous alloy thin strips, each having a thickness of 25 μm, a width of 200 mm and a surface roughness of about 0.6 μm in terms of a mean roughness along the centerline Ra, were manufactured from molten alloys having various compositions listed in Table 1 in the same manner as Example 1.

Figure 6:
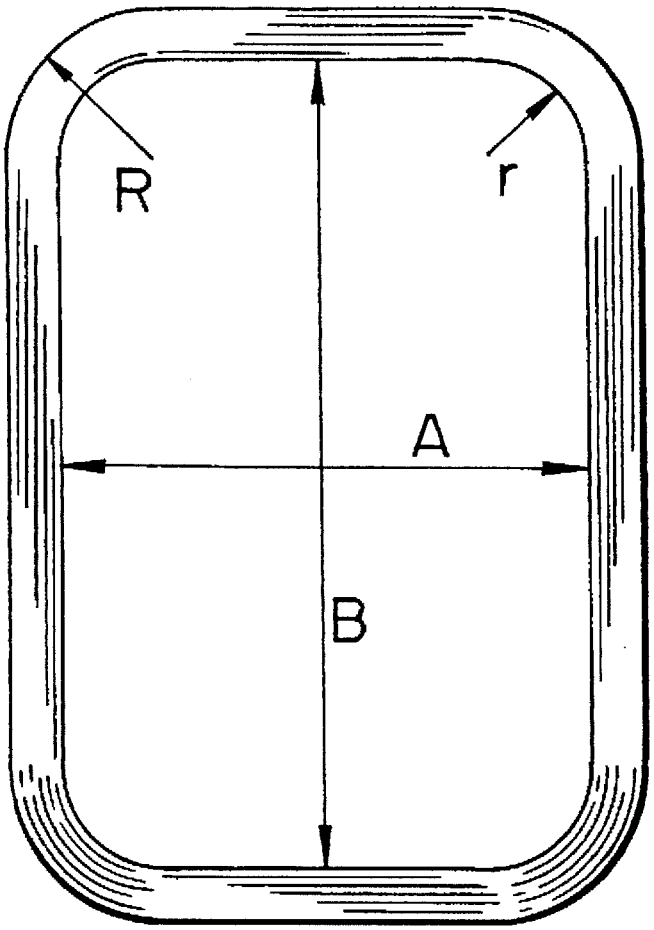
FIG. 6 illustrates the dimensions of a non-circular wound core sample.

Non-circular core samples having various dimensions shown in FIG. 6 were manufactured from the obtained thin strips. The iron loss $W_{13/50}$ and building factor thereof were measured after each of the thin strips was annealed at 320° to 420° C. in an inert atmosphere for an hour while a magnetic field of 10 Oe was applied to the sample in a circumferential direction thereof. The results of the measurements are also shown in Table 1.

Table 1 also lists the results of the investigations conducted on conventional thin strips in which no Mn is added.

TABLE 1

| SAMPLE No. | COMPOSITION (%) | DIMENSIONS (mm) A | B | r | R | IRON LOSS OF WOUND CORE $W_{13/50}$(W/kg) | BUILDING FACTOR | EXAMPLES |
|---|---|---|---|---|---|---|---|---|
| 1 | $Fe_{78.6}B_9Si_{12}Mn_{0.4}$ | 60 | 80 | 20 | 25 | 0.120 | 1.20 | This invention |
| 2 | $Fe_{78.4}B_9Si_{12}Mn_{0.6}$ | 60 | 80 | 20 | 25 | 0.119 | 1.19 | This invention |
| 3 | $Fe_{79.4}B_{11.5}Si_{8.7}Mn_{0.4}$ | 60 | 80 | 20 | 25 | 0.111 | 1.19 | This invention |
| 4 | $Fe_{79.4}B_{12}Si_8Mn_{0.6}$ | 60 | 80 | 20 | 25 | 0.115 | 1.12 | This invention |
| 5 | $Fe_{80}B_{12}Si_{7.5}Mn_{0.5}$ | 60 | 80 | 20 | 25 | 0.114 | 1.10 | This invention |
| 6 | $Fe_{80.4}B_{13}Si_{6.2}Mn_{0.4}$ | 60 | 80 | 20 | 25 | 0.115 | 1.11 | This invention |
| 7 | $Fe_{80.9}B_{12}Si_{6.5}Mn_{0.6}$ | 100 | 120 | 40 | 45 | 0.120 | 1.20 | This invention |
| 8 | $Fe_{81.1}B_{12}Si_{6.5}Mn_{0.4}$ | 100 | 120 | 40 | 45 | 0.121 | L.20 | This invention |
| 9 | $Fe_{81.5}B_{13}Si_{4.9}Mn_{0.6}$ | 100 | 120 | 40 | 45 | 0.128 | 1.21 | This invention |
| 10 | $Fe_{78.6}B_{13}Si_8Mn_{0.4}$ | 100 | 120 | 40 | 45 | 0.110 | 1.20 | This invention |
| 11 | $Fe_{79}B_{13}Si_8$ | 100 | 120 | 40 | 45 | 0.193 | 1.75 | Comparative |
| 12 | $Fe_{89.5}B_9Si_{12.5}$ | 100 | 120 | 40 | 45 | 0.205 | 1.72 | Comparative |
| 13 | $Fe_{80}B_{13}Si_7$ | 60 | 80 | 20 | 25 | 0.177 | 1.65 | Comparative |
| 14 | $Fe_{81}B_{12}Si_7$ | 60 | 80 | 20 | 25 | 0.207 | 1.70 | Comparative |
| 15 | $Fe_{81}B_{13}Si_6$ | 60 | 80 | 20 | 25 | 0.209 | 1.75 | Comparative |

As is apparent from Table 1, the amorphous alloy thin strips according to the present invention have very low iron loss values and low building factors even in non-circular wound cores.

As will be understood from the foregoing description, a Fe—B—Si type amorphous alloy thin strip in which an adequate amount of Mn is present has an excellent iron loss value both in a single strip and in a wound core, particularly in a wound core which is bent at a radius of 50 mm or below.

The present inventors hypothesize that the improvement in the iron loss value occurs for at least the following reasons: addition of Mn reduces deterioration in the iron loss, which occurs under stress, as mentioned in connection with FIG. 2. Furthermore, when Mn is present in the alloy thin strip, part of Mn concentrates on the surface of the thin strip, and improves electric resistance near the surface. As a result, an increase in the eddy current loss caused by the interaction between the laminated thin strips is reduced.

When the material exhibiting the above-described characteristics is used to manufacture a wound transformer, a transformer exhibiting excellent characteristics can be obtained. Such effects cannot be clarified if the evaluation is conducted on a single strip alone. Also, in the invention, the transformer can be manufactured without the need for additional material or steps such as further treatment of the strip by adjusting roughness or like. Thus, the findings offered by the present invention are very useful in practical applications.

It is thus possible according to the present invention to provide a material which is excellent at a practical level as a transformer material and can thus contribute to energy conservation.

What is claimed is:

1. An iron-based amorphous alloy thin strip for wound transformers which has a composition consisting essentially of:

$Fe_aB_bSi_cMn_d$ where about 78≦a≦ about 82 at %, about 8≦b≦ about 15 at %, 4≦c≦ about 14 at %, and about 0.2≦d≦ about 1.0 at %, and in which a ratio (building factor) of iron loss of a wound core obtained from said alloy thin strip to iron loss of a single piece of said alloy thin strip is about 1.5 or less.

2. The iron-based amorphous alloy thin strip according to claim 1, wherein said amorphous alloy thin strip is bent into a wound core having a radius of about 50 mm or less.

3. A transformer comprising an iron-based amorphous alloy thin strip bent into a wound core, said strip having a composition consisting essentially of:

$Fe_aB_bSi_cMn_d$ where about 78≦a≦ about 82 at %, about 8≦b≦ about 15 at %, 4≦c≦ about 14 at %, and about 0.2≦d≦ about 1.0 at %, and in which a ratio of iron loss of said wound core to the iron loss of a single piece of said alloy thin strip is about 1.5 or less.

4. The transformer defined in claim 3 wherein the iron loss of said wound core is about 0.15 w/kg or less.

5. The transformer defined in claim 3 wherein said wound core has a radius of about 50 mm or less.

* * * * *

UNITED STATES PATENT AND TRADEMARK OFFICE

CERTIFICATE OF CORRECTION

PATENT NO. : 5,658,397

DATED : August 19, 1997

INVENTOR(S) : Fumio Kogiku, Masao Yukumoto and Kensuke Matsuki

It is certified that error appears in the above-indentified patent and that said Letters Patent is hereby corrected as shown below:

In Column 6, under Table 1, second column, line 12, please change "$Fe_{89.5}B_9Si_{12.5}$" to --$Fe_{78.5}B_9Si_{12.5}$--; and eighth column, line 8, please change "L.20" to --1.20--.

Signed and Sealed this

Twenty-eighth Day of October, 1997

Bruce Lehman

*Attest:*

BRUCE LEHMAN

*Attesting Officer*

*Commissioner of Patents and Trademarks*